US009252518B2

(12) United States Patent
Miwa et al.

(10) Patent No.: US 9,252,518 B2
(45) Date of Patent: Feb. 2, 2016

(54) ELECTRIC CONNECTION STRUCTURE OF ELECTRONIC COMPONENT

(71) Applicant: Aisin Seiki Kabushiki Kaisha, Kariya-shi (JP)

(72) Inventors: Takahiro Miwa, Obu (JP); Masahiro Kimura, Chiryu (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 0 days.

(21) Appl. No.: 14/572,906

(22) Filed: Dec. 17, 2014

(65) Prior Publication Data

US 2015/0180152 A1 Jun. 25, 2015

(30) Foreign Application Priority Data

Dec. 20, 2013 (JP) ..... 2013-264107

(51) Int. Cl.

| | |
|---|---|
| ***H01R 4/24*** | (2006.01) |
| ***H01R 13/08*** | (2006.01) |
| ***H01R 12/71*** | (2011.01) |
| ***H01R 13/66*** | (2006.01) |
| ***H01R 12/52*** | (2011.01) |
| *H01R 12/70* | (2011.01) |
| *H01R 13/506* | (2006.01) |

(52) U.S. Cl.

CPC ..... *H01R 13/08* (2013.01); *H01R 12/52* (2013.01); *H01R 12/714* (2013.01); *H01R 13/6683* (2013.01); *H01R 12/7023* (2013.01); *H01R 13/506* (2013.01)

(58) Field of Classification Search

CPC ..... H01R 4/2433; H01R 9/0742
USPC ..... 439/417, 499, 404, 405
See application file for complete search history.

(56) References Cited

U.S. PATENT DOCUMENTS

| | | | | |
|---|---|---|---|---|
| 4,008,941 | A * | 2/1977 | Smith | H01R 24/50 439/358 |
| 4,068,912 | A * | 1/1978 | Hudson, Jr. | H01R 12/675 29/857 |
| 5,037,308 | A | 8/1991 | Bryce et al. | |
| 5,057,650 | A * | 10/1991 | Urushibata | H01R 13/504 174/72 A |
| 7,916,489 | B2 | 3/2011 | Okuya | |
| 2007/0232143 | A1 | 10/2007 | Yang et al. | |
| 2012/0302106 | A1 | 11/2012 | Chang | |

FOREIGN PATENT DOCUMENTS

| | | |
|---|---|---|
| JP | 2008-124062 | 5/2008 |

OTHER PUBLICATIONS

Search Report issued Mar. 30, 2015 in European Patent Application No. 14198402.1.

* cited by examiner

*Primary Examiner* — Phuongchi T Nguyen
(74) *Attorney, Agent, or Firm* — Oblon, McClelland, Maier & Neustadt, L.L.P

(57) ABSTRACT

An electric connection structure of an electronic component includes: an electric conductor that has a connection pin formed of an electric conductive metal and in which a contact is formed in an end portion opposite to the connection pin; an electronic component that has a metal terminal for inputting and outputting an electric signal, on a bottom surface which opposes the electric conductor; and a housing that has a holding portion for holding the electric conductor and a fixing portion for fixing the electronic component, wherein the electronic component is brought into contact with the housing, and is fixed by the fixing portion so that the contact is elastically deformed and the metal terminal and the contact are electrically connected to each other.

6 Claims, 4 Drawing Sheets

ELECTRIC CONNECTION STRUCTURE OF ELECTRONIC COMPONENT

CROSS REFERENCE TO RELATED APPLICATIONS

This application is based on and claims priority under 35 U.S.C. §119 to Japanese Patent Application 2013-264107, filed on Dec. 20, 2013, the entire contents of which are incorporated herein by reference.

TECHNICAL FIELD

This disclosure relates to an electric connection structure that can achieve stable electric connection between an electronic component and a connection pin without using soldering.

BACKGROUND DISCUSSION

In the related art, as one of the methods for inputting and outputting an electric signal in a printed board on which various circuit components are mounted, a method has been employed in which a connection pin and the printed board are electrically connected to each other by means of soldering after inserting the connection pin into a through-hole formed in an end portion of the printed board.

JP 2008-124062A (Reference 1) discloses a rotation angle detection device in which a pin-shaped terminal which is one end portion of a contact pin bent in an L-shape is inserted into a mounting through-hole formed in an end portion of a wiring board (PCB) on which a Hall element is mounted, and the pin-shaped terminal and a land of PCB are bonded to each other by means of soldering so that the contact pin and PCB are electrically connected to each other. In the rotation angle detection device, PCB is mounted inside a detection side housing in a state where PCB is electrically connected to the contact pin. Then, a thermal caulking piece formed inside the detection side housing is melted and tilted by heat, and is hooked to an edge of PCB, thereby fixing PCB to the detection side housing.

The rotation detection device disclosed in Reference 1 adopts a structure in which the pin-shaped terminal is inserted into the mounting through-hole of PCB so that the PCB and the contact pin are bonded to each other by means of soldering. Accordingly, it is necessary to provide a soldering process for electric connection therebetween. Therefore, it is necessary to use laser facilities required for the soldering in order to automate the soldering process. In addition, it is necessary to very accurately perform positioning for a relative position of the mounting through-hole and the pin-shaped terminal in order to insert the pin-shaped terminal into the mounting through-hole. Consequently, assembly man-hours increase greatly. Furthermore, it is also necessary to provide a thermal caulking process, and it is necessary to use a thermal caulking device in order to fix PCB to the detection side housing. Since these facilities and man-hours increase the manufacturing cost of the rotation detection device, there is room for further improvement.

SUMMARY

Thus, a need exists for a structure which is not suspectable to the drawback mentioned above.

An aspect of this disclosure is directed to an electric connection structure of an electronic component including an electric conductor that has a connection pin formed of an electric conductive metal and in which a contact is formed in an end portion opposite to the connection pin, an electronic component that has a metal terminal for inputting and outputting an electric signal, on a bottom surface which opposes the electric conductor, and a housing that has a holding portion for holding the electric conductor and a fixing portion for fixing the electronic component. The electronic component is brought into contact with the housing, and is fixed by the fixing portion so that the contact is elastically deformed and the metal terminal and the contact are electrically connected to each other.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

1. First Embodiment

Figure 1:
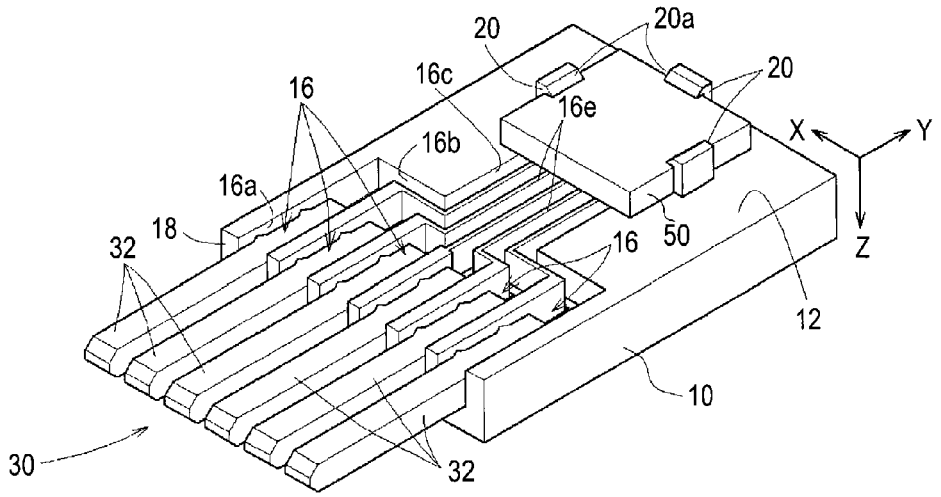
FIG. 1 is a perspective view illustrating an electric connection structure according to a first embodiment disclosed here.

Hereinafter, a first embodiment disclosed here will be described in detail with reference to the drawings. As illustrated in FIG. 1, an electric connection structure according to the embodiment disclosed here is achieved by electrically connecting an electric conductor 30 accommodated in a housing 10 and a circuit package 50 to each other. The circuit package 50 is an example of an electronic component.

Figure 2:
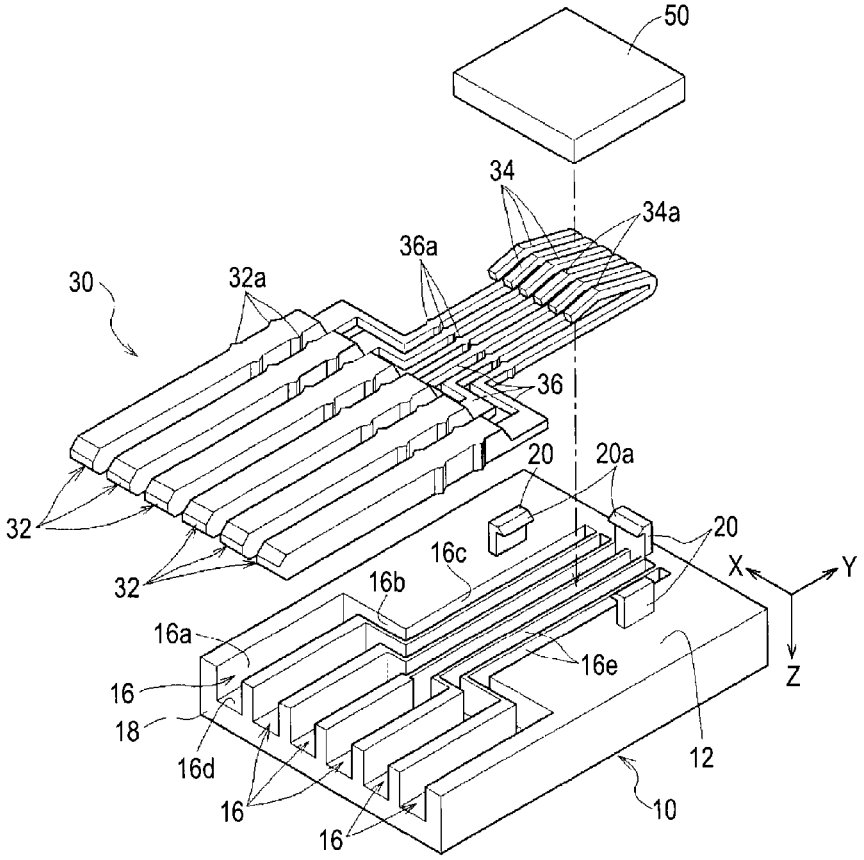
FIG. 2 is an exploded perspective view illustrating a configuration of the electric connection structure.

As illustrated in FIG. 2, the housing 10 is made of a resin formed by using an injection molding method, and has a rectangular parallelepiped shape. The housing 10 has six crank-shaped grooves 16 which are carved from an upper surface 12 in a Z-direction and are formed from a side surface 18 in a Y-direction. The respective grooves 16 are configured by combining a first portion 16*a* and a third portion 16*c* which are two grooves parallel to the Y-direction, and a second portion 16*b* which connects respective end portions of the first portion 16*a* and the third portion 16*c* and is parallel to an X-direction. A groove width of the first portion 16*a* is wide, and a groove width of the second portion 16*b* and the third portion 16*c* is narrow. The six grooves 16 respectively have the same depth. A bottom surface 16*d* of the groove 16 is configured as one plane, regardless of the first portion 16*a*, the second portion 16*b*, and the third portion 16*c*.

A snap-fit connector 20 is formed around the third portion 16*c* at three locations on the upper surface 12. The snap-fit connector 20 is an example of a fixing portion. The snap-fit connector 20 is disposed to be erect vertically on the upper surface 12. A pawl portion 20*a* protruding in a direction toward the third portion 16*c* is formed at each distal end of the snap-fit connectors 20.

Six electric conductors 30 are provided, and both of these have a crank shape. As illustrated in FIG. 1, the six electric conductors 30 are respectively accommodated in the six grooves 16. Each width of the electric conductors 30 in the X-direction is fitted to the groove 16 without any gap. A thickness in the Z-direction is slightly thinner than the depth of the groove 16. As illustrated in FIG. 2, the electric conductor 30 has a connection pin 32 formed in one end portion, a contact 34 formed in the other end portion, and a connection portion 36 which electrically connects the connection pin 32 and the contact 34 to each other. The electric conductor 30 is formed of a highly conductive spring material such as phosphor bronze or beryllium copper, and is manufactured by pressing a single plate material. Depending on purpose of use, plated layers including gold, palladium, tin, or nickel are formed on a surface of the electric conductor 30, thereby preventing oxidation and corrosion of the surface. For example, a nickel-plated layer can be formed in all the electric conductors 30, a tin-plated layer can be formed on the nickel-plated layer in the connection pin 32, and a gold-plated layer can be formed in the contact 34.

The connection pin 32 needs enough strength to function as an outward connection terminal. Both the width in the X-direction and the thickness in the Z-direction are larger than those of the contact 34. On the other hand, the contact 34 is configured to be thin in the Z-direction in order to have an elastic force, and is configured to have a decreased width in the X-direction by matching an inter-terminal pitch of a metal terminal 52 located on a bottom surface 54 of the circuit package 50 (to be described later). That is, a cross-sectional area perpendicular to the Y direction of the connection pin 32 is configured to be larger than a cross-sectional area perpendicular to the Y direction of the contact 34. The width in the X-direction and the thickness in the Z-direction of the connection portion 36 are the same as those of the contact 34. A shape in which the thickness in the Z-direction is continuously changed from the connection pin 32 to the connection portion 36 is obtained by rolling and thinning only a portion of the material.

The respective connection pins 32 have a press-fitting portion 32*a* at two locations in which the width in the X-direction is slightly wider than that at the other locations. In addition, the connection portion 36 also has a press-fitting portion 36*a* at one location in which the width in the X-direction is slightly wider than that at the other locations in the same manner. The width of the press-fitting portions 32*a* and 36*a* in the X-direction is slightly wider than the groove width of the first portion 16*a* and the third portion 16*c* of the housing 10 in the X-direction.

When the electric conductor 30 is accommodated in the groove 16, the press-fitting portions 32*a* and 36*a* respectively bite into a side wall 16*e* disposed in the first portion 16*a* and the third portion 16*c*, within the side walls 16*e* of the groove 16, and are inserted until the press-fitting portions 32*a* and 36*a* come into contact with the bottom surface 16*d*. In this manner, the connection pin 32 and the contact 34 are respectively accommodated and held in the first portion 16*a* and the third portion 16*c*. The connection portion 36 is accommodated from the first portion 16*a* to the third portion 16*c*. A location within the first portion 16*a* and the third portion 16*c* of the groove 16 which is bitten into by the press-fitting portions 32*a* and 36*a* corresponds to a holding portion. It is possible to prevent an external force applied to the connection pin 32 from affecting the contact 34, by disposing the press-fitting portions 32*a* and 36*a*. When the width of a portion of the electric conductor 30 in the X-direction is widened so as to form the press-fitting portions 32*a* and 36*a*, it is not necessary to provide an additional process, since the electric conductor 30 can be manufactured only by changing a shape of a punch and a die during a manufacturing process thereof. In addition, the press-fitting is achieved with the result that the electric conductor 30 is accommodated in the groove 16, and thus does not need an additional process. Therefore, the electric conductor 30 can be held in the groove 16 without any increased cost.

Figure 3:
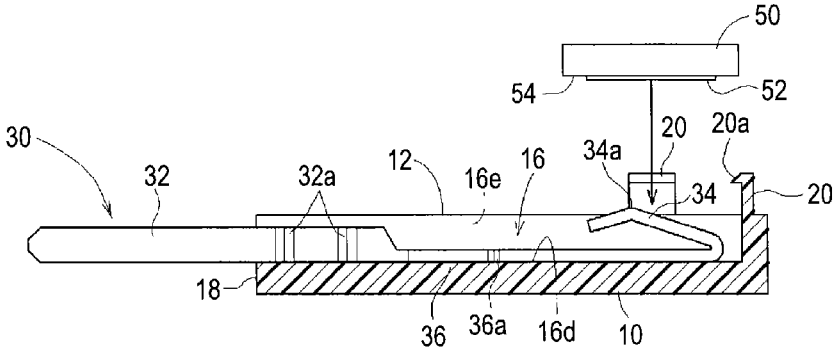
FIG. 3 is a cross-sectional view illustrating a state before a circuit package is mounted on a housing.

In a state where the electric conductor 30 is accommodated in the groove 16, the connection pin 32 extends outward from the housing 10 as illustrated in FIG. 1. Alternatively, a contact point 34*a* of the contact 34 protrudes upward from the upper surface 12 as illustrated in FIG. 3. As described above, the electric conductor 30 adopts a configuration in which most of the electric conductor 30 excluding a portion of the connection pin 32 and the contact point 34*a* is accommodated in the groove 16. Accordingly, even if an unexpected external force is applied to the electric conductor 30, the side wall 16*e* of the groove 16 regulates a movement of the respective electric conductors 30 in an arrangement direction (X-direction). Therefore, it is possible to reliably maintain insulation between the electric conductors 30 adjacent to each other.

Figure 4:
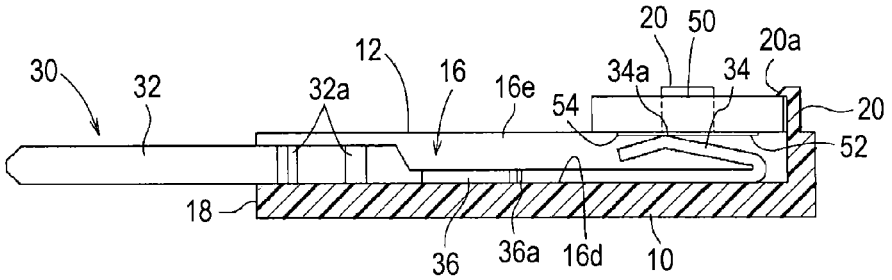
FIG. 4 is a cross-sectional view illustrating a state where the circuit package is mounted on the housing.

The circuit package 50 internally accommodates an electric circuit and an electronic circuit. An electric signal is input and output via six metal terminals 52 formed on the bottom surface 54 which is a surface opposing the electric conductor 30. If the circuit package 50 is moved closer to the upper surface 12 in a state that the bottom surface 54 of the circuit package 50 and the contact 34 oppose each other, the pawl portion 20*a* of the snap-fit connector 20 is hooked to the top surface of the circuit package 50, and the circuit package 50 is fixed onto the upper surface 12, as illustrated in FIG. 4. At this time, the six contacts 34 are elastically deformed, and the six metal terminals 52 respectively come into contact with the contact points 34*a* of the contacts 34. This allows the connection pin 32 and the internal circuit of the circuit package 50 to be electrically connected to each other.

As described above, the circuit package 50 is fixed to the housing 10 using the snap-fit connector 20, and the contact 34 is elastically deformed so that the internal circuit of the circuit package 50 and the connection pin 32 are electrically connected to each other via the metal terminal 52. Therefore, it is no longer necessary to provide a process of inserting the connection pin 32 into a through-hole, a soldering process, and a thermal caulking process which are required for the rotation detection device disclosed in Reference 1. Accordingly, it is possible to easily and inexpensively achieve the electric connection between the internal circuit of the circuit package 50 and the connection pin 32. In addition, gold-plated layers are respectively formed in the contact point 34*a* and the metal terminal 52. In this manner, even if a contact force between the contact point 34*a* and the metal terminal 52 decreases, it is possible to maintain contact resistance to be low. Therefore, it is possible to improve contact reliability.

The circuit package 50 may be configured so that an electronic circuit board is covered with a resin, metal, or ceramic, or may be the electronic circuit board itself. In addition, a type (function) of the circuit package 50 is not particularly limited, and any desired type may be used. For example, if the circuit package 50 is a magnetic sensor, it is possible to detect magnetism of a magnet (not illustrated) away from the top surface of the circuit package 50 in the Z-direction. In this case, the pawl portion 20*a* of the snap-fit connector 20 is formed very accurately. In this manner, it is possible to fix the circuit package 50 to the housing 10 so that the top surface and the bottom surface of the circuit package 50 are parallel to the upper surface 12 of the housing 10. If the top surface of the circuit package 50 is parallel to the upper surface 12 of the housing 10, it is possible to cause the top surface of the circuit package 50 to directly face the magnet. Accordingly, it is possible to very accurately detect the magnetism of the magnet. In addition, if the bottom surface of the circuit package 50 is parallel to the upper surface 12 of the housing 10, it is possible to equalize respective contact forces between the six contacts 34 and the metal terminals 52. Accordingly, it is possible to improve contact reliability of all the contacts 34.

The embodiment disclosed here is configured so that the electric conductor 30 is formed by pressing a single plate material, but is not limited thereto. The connection pin 32, the contact 34, and the connection portion 36 may be respectively formed of a separate material, and may be bonded to one another by means of a welding method. The connection pin 32 needs electric conductivity and strength, and the contact 34 needs electric conductivity and a spring function. Therefore, it is possible to form the electric conductor 30 by forming the separate material and using the optimum material according to the respective characteristics.

Figure 5A:
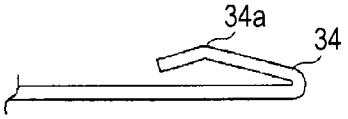
FIG. 5A is a side view illustrating a contact according to an embodiment disclosed here.
Figure 5B:
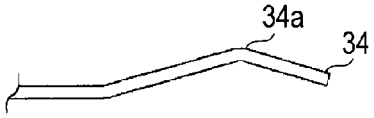
FIG. 5B is a side view illustrating a contact according to a modification example disclosed here.
Figure 5C:
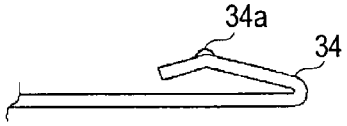
FIG. 5C is a side view illustrating a contact according to a modification example disclosed here.
Figure 5D:
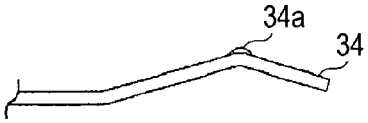
FIG. 5D is a side view illustrating a contact according to a modification example disclosed here.

The shape of the contact 34 is not limited to a bent type illustrated in FIGS. 1 to 5A, and may be a shape as illustrated in FIG. 5B. In addition, as illustrated in FIGS. 5C and 5D, a projection may be disposed at an apex of the contact point 34*a*. In this manner, contact pressure of the contact point 34*a* against the metal terminal 52 increases. Accordingly, it is possible to improve contact reliability. The shape of the contact 34 and the contact point 34*a* is not limited to shapes illustrated in FIGS. 5A to 5D. Any desired shape can be employed according to a contact force needed to maintain the material and performance.

2. Second Embodiment

Next, a second embodiment will be described in detail with reference to the drawings. In the embodiment disclosed here, a shape of the housing 10 and the contact 34 is different from that in the first embodiment, and the other points are the same as each other.

Figure 6:
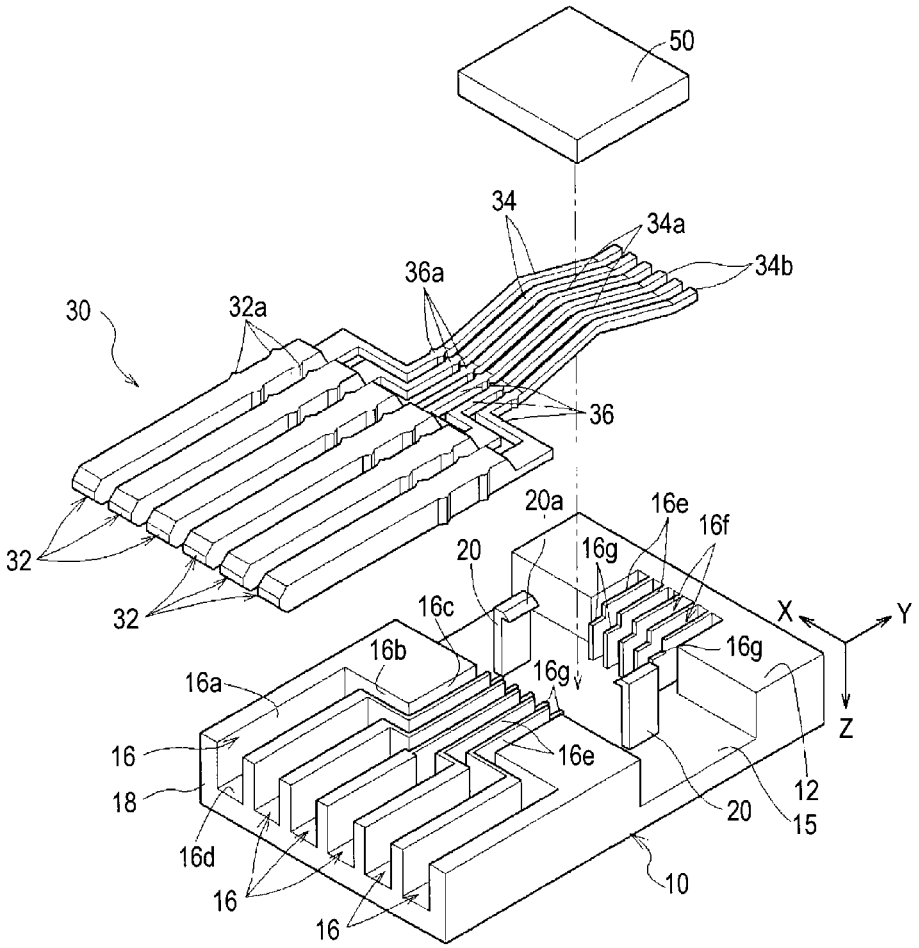
FIG. 6 is an exploded perspective view illustrating a configuration of an electric connection structure according to a second embodiment disclosed here.

As illustrated in FIG. 6, the housing 10 according to the embodiment disclosed here is configured so that a location for mounting the circuit package 50 thereon has a recess 14 which is recessed from the upper surface 12. The groove 16 is not formed on a bottom surface 15 of the recess 14, and the bottom surface 15 has a planar shape. That is, the third portion 16*c* of the groove 16 is intermediately divided by the recess 14. Hereinafter, in the embodiment disclosed here, the third portion 16*c* which is divided and is not connected to the second portion 16*b* is referred to as a divided portion 16*f*. The snap-fit connector 20 is disposed to be erect from the bottom surface 15, and is formed at only two locations which oppose each other.

Figure 7:
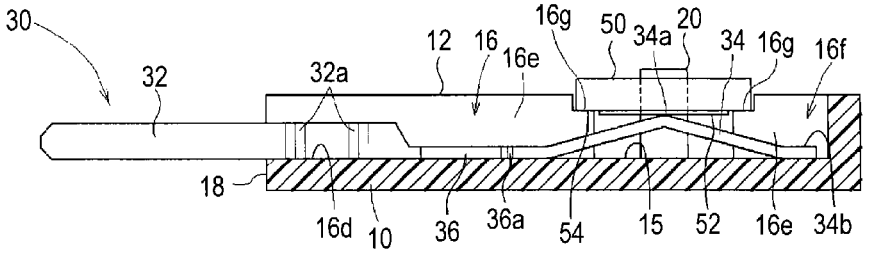
FIG. 7 is a cross-sectional view illustrating a state where a circuit package is mounted on a housing.

Five support portions 16*g* whose heights are respectively lower than that of the upper surface 12 extend slightly toward the recess 14 side from the side wall 16*e* of the third portion 16*c* and the side wall 16*e* of the divided portion 16*f* which are formed on both sides of the recess 14 along the Y-direction. Since the support portion 16*g* is formed, when the circuit package 50 is mounted on the housing 10, the circuit package 50 can be supported in a state of being away from the bottom surface 15, as illustrated in FIG. 7. In this manner, a space is formed between the bottom surface 54 of the circuit package 50 and the bottom surface 15. Accordingly, it is possible to prevent the contact 34 from being excessively deformed when the circuit package 50 is mounted thereon. In addition, both the top surface and the bottom surface 54 of the circuit package 50 are exposed to the outside air, thereby improving heat radiation.

The contact 34 according to the embodiment disclosed here has an extension portion 34*b* whose distal end is further extended from the shape illustrated in FIG. 5B. In a state where the electric conductor 30 is accommodated in the housing 10 and the circuit package 50 is not yet mounted thereon, the extension portion 34*b* does not come into contact with the bottom surface 16*d*, and is located in the space inside the divided portion 16*f*. That is, the contact 34 has a cantilever shape. Then, the circuit package 50 moves close to the support portion 16*g* so as to be mounted on the housing 10 and immediately before the snap-fit connector 20 is hooked to the top surface of the circuit package 50, the extension portion 34*b* comes into contact with the bottom surface 16*d*, and the contact 34 has a double-supported beam shape. Thereafter, the extension portion 34*b* slides on the bottom surface 16*d* and the contact 34 is deformed until the circuit package 50 is hooked to the snap-fit connector 20 and the bottom surface 54 comes into contact with the support portion 16*g*. If the contact 34 has the double-supported beam shape, a spring constant thereof further increases as compared to the cantilever shape. Accordingly, in a state where the circuit package 50 is mounted on the housing 10, the contact force increases, thereby improving the contact reliability.

The embodiment disclosed here is configured so that the extension portion 34*b* has a linear shape, but is not limited to the shape. The embodiment disclosed here may adopt a configuration in which a distal end of the extension portion 34*b* is not allowed to come into contact with the bottom surface 16*d* by forming the extension portion 34*b* into a shape which is convexly curved toward the bottom surface 16*d* so that the distal end of the extension portion 34*b* is less likely to be hooked to the bottom surface 16*d* and is likely to slide thereon.

As long as the required contact force can be ensured and the distal end is accommodated in the divided portion 16*f*, it is not necessary to dispose the extension portion 34*b*. A shape of the contact 34 illustrated in FIG. 5B may also be employed. In addition, any shape in FIGS. 5A, 5C, and 5D may be employed, or another shape may be employed.

In the embodiment disclosed here, the extension portion 34*b* of the contact 34 is accommodated in the divided portion 16*f*, as illustrated in FIG. 7. Therefore, if the electric conductor 30 is used whose width in the X-direction is increased further than the width in the Z-direction by pressing a plate material, even when the groove 16 is not disposed in the recess 14, the contact 34 is not deformed in the X-direction. Therefore, there is no possibility that the adjacent contacts 34 may be short-circuited by coming into contact with each other.

The embodiments disclosed here are configured so that the electric conductor 30 is obtained by pressing the plate material, but are not limited thereto. A highly conductive rod material having an excellent spring function may be cut and bent to configure the electric conductor 30. In this case, it is not possible to change a cross-sectional area of the connection pin 32 and the contact 34. In addition, in this case, it is not possible to form the press-fitting portion 36*a* in the electric conductor 30. Accordingly, it is necessary to separately dispose a structure for holding the electric conductor 30 inside the groove 16.

The embodiments disclosed here are configured so that the press-fitting portions 32*a* and 36*a* are disposed and press-fitted to a portion of the electric conductor 30, but are not limited thereto. For example, without disposing the press-fitting portions 32*a* and 36*a* in the electric conductor 30, a plurality of projections corresponding to the holding portion may be alternatively formed from the side wall 16*e* toward the space inside the groove 16, and the width of the groove 16 in the X-direction may be narrowed at locations thereof. That is, the projections enable the electric conductor 30 to be press-fitted into and held in the groove 16. When the projections are formed in a portion of the groove 16, it is not necessary to provide an additional process, since the projections can be formed only by changing a shape of a mold during a manufacturing process for the housing 10 using injection molding. In addition, the press-fitting is achieved with the result that the electric conductor 30 is accommodated in the groove 16, and thus does not need an additional process. Therefore, the electric conductor 30 can be held in the groove 16 without any increased cost. As described above, any desired method can be employed in order to hold the electric conductor 30 in the groove 16.

The embodiments disclosed here can be used in an electric connection structure that can achieve stable electric connection between an electronic component and a connection pin without using soldering.

An aspect of this disclosure is directed to an electric connection structure of an electronic component including an electric conductor that has a connection pin formed of an electric conductive metal and in which a contact is formed in an end portion opposite to the connection pin, an electronic component that has a metal terminal for inputting and outputting an electric signal, on a bottom surface which opposes the electric conductor, and a housing that has a holding portion for holding the electric conductor and a fixing portion for fixing the electronic component. The electronic component is brought into contact with the housing, and is fixed by the fixing portion so that the contact is elastically deformed and the metal terminal and the contact are electrically connected to each other.

According to this configuration, it is no longer necessary to provide a process of inserting a connection pin into a through-hole and a soldering process which are required for the rotation detection device disclosed in Reference 1. Accordingly, it is possible to easily, inexpensively, and reliably achieve electric connection between an internal circuit of the electronic component and the connection pin.

In the electric connection structure of an electronic component according to the aspect of this disclosure, it is preferable that the electric connection structure includes a plurality of the electric conductors, and the housing has a plurality of grooves which respectively and separately accommodate at least a portion of the plurality of the electric conductors, and that the grooves regulate a movement of the electric conductors in an arrangement direction.

According to this configuration, even when an unexpected external force is applied to the electric conductor, the grooves regulate the movement of the respective electric conductors in the arrangement direction. Therefore, it is possible to reliably maintain insulation between the electric conductors adjacent to each other.

In the electric connection structure of an electronic component according to the aspect of this disclosure, it is preferable that the holding portion is a portion of the groove, and a press-fitting portion of the electric conductor is press-fitted to the holding portion.

According to this configuration, for example, the electric conductor can be stably held in the groove by changing a portion of any one width of the electric conductor and the groove and by preparing a dimensional relationship which allows the electric conductor to be press-fitted to the groove. Narrowing a portion of any one width of the electric conductor and the groove does not need an additional process during a manufacturing course of the electric conductor and the housing. In addition, the press-fitting is achieved with the result that the electric conductor is accommodated in the groove, and thus does not need an additional process. Therefore, the electric conductor can be held in the groove without any increased cost.

In the electric connection structure of an electronic component according to the aspect of this disclosure, it is preferable that the fixing portion is configured as a plurality of snap-fit connectors formed integrally with the housing, and that a pawl portion of each the plurality of snap-fit connectors is hooked to a top surface of the electronic component so as to fix the electronic component to the housing.

According to this configuration, the electronic component is fixed to the housing using the snap-fit connector, and the contact is elastically deformed. In this manner, the internal circuit of the electronic component and the connection pin are electrically connected to each other via the metal terminal. Accordingly, it is no longer necessary to provide the thermal caulking process required for the rotation detection device disclosed in Reference 1. Therefore, it is possible to easily and inexpensively fix the electronic component to the housing.

In the electric connection structure of an electronic component according to the aspect of this disclosure, it is preferable that the contact is located inside a space formed by the bottom surface of the electronic component and the housing, in a state where the electronic component is fixed to the housing.

According to this configuration, it is possible to prevent the contact from being excessively deformed when the electronic component is mounted on the housing.

In the electric connection structure of an electronic component according to the aspect of this disclosure, it is preferable that the electronic component is a sensor which can detect information relating to a detection target.

When the electronic component is fixed using the snap-fit connector, the pawl portion of the snap-fit connector is formed very accurately. In this manner, it is possible to fix the electronic component to the housing so that the top surface and the bottom surface of the electronic component are parallel to an upper surface of the housing. If the top surface of the electronic component is parallel to the upper surface of the housing, even when the detection target is present apart from the top surface of the electronic component, it is possible to cause the top surface of the electronic component to directly face the detection target. Accordingly, it is possible to very accurately detect information relating to the detection target. In addition, if the bottom surface of the electronic component is parallel to the upper surface of the housing, even when a plurality of the electric conductors are provided, it is possible to equalize respective contact forces between the contacts and the metal terminals. Accordingly, it is possible to improve contact reliability of all the contacts.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. An electric connection structure of an electronic component comprising:

an electric conductor that has a connection pin formed of an electric conductive metal and in which a contact is formed in an end portion opposite to the connection pin;

an electronic component that has a metal terminal for inputting and outputting an electric signal, on a bottom surface which opposes the electric conductor; and a housing that has a holding portion for holding the electric conductor and a fixing portion for fixing the electronic component, wherein the electronic component is brought into contact with the housing, and is fixed by the fixing portion so that the contact is elastically deformed and the metal terminal and the contact are electrically connected to each other.

2. The electric connection structure of an electronic component according to claim 1, wherein the fixing portion is configured as a plurality of snap-fit connectors formed integrally with the housing, and wherein a pawl portion of each the plurality of snap-fit connectors is hooked to a top surface of the electronic component so as to fix the electronic component to the housing.

3. The electric connection structure of an electronic component according to claim 1, wherein the contact is located inside a space formed by the bottom surface of the electronic component and the housing, in a state where the electronic component is fixed to the housing.

4. The electric connection structure of an electronic component according to claim 1, wherein the electronic component is a sensor which can detect information relating to a detection target.

5. The electric connection structure of an electronic component according to claim 1, wherein the electric connection structure includes a plurality of the electric conductors, and wherein the housing has a plurality of grooves which respectively and separately accommodate at least a portion of the plurality of the electric conductors, and the grooves regulate a movement of the electric conductors in an arrangement direction.

6. The electric connection structure of an electronic component according to claim 5, wherein the holding portion is a portion of the groove, and a press-fitting portion of the electric conductor is press-fitted to the holding portion.

* * * * *